United States Patent [19]

Tracy

[11] 4,277,989

[45] Jul. 14, 1981

[54] RATCHET WRENCH HANDLE

[76] Inventor: Kurt L. Tracy, Kendrew Rd., Rensselaer Falls, N.Y. 13680

[21] Appl. No.: 35,103

[22] Filed: May 1, 1979

[51] Int. Cl.[3] ..... B25B 13/46

[52] U.S. Cl. ..... 81/62; 192/43.1

[58] Field of Search ..... 81/60–63.2; 192/43.1

[56] References Cited

U.S. PATENT DOCUMENTS

| | | | |
|---|---|---|---|
| 663,294 | 12/1900 | Nesley | 81/62 |
| 1,071,687 | 9/1913 | Becklin | 81/63 |
| 1,509,632 | 9/1924 | Bracci | 81/63 |
| 1,680,515 | 8/1928 | Gormley | 81/63 |

*Primary Examiner*—James L. Jones, Jr.

*Attorney, Agent, or Firm*—Bruns & Jenney

[57] ABSTRACT

A reversible ratchet wrench handle in which the actuator for the direction reversing mechanism is located close to the portion of the handle that is grasped by the user. This permits the user to operate the actuator with the thumb of the hand holding the handle whereby changing the direction of operation of the wrench is a one handed rather than a two handed operation. Locating the actuator near the hand grip portion of the handle also removes it from the head of the handle, the usual location, and this allows the head to be made thinner for better access to narrow places. The actuator for the direction reversing mechanism is a switch button that is movable back and forth axially of the wrench handle and this kind of movement insures more positive action.

7 Claims, 5 Drawing Figures

RATCHET WRENCH HANDLE

BACKGROUND OF THE INVENTION

This invention relates generally to hand tools, and has particular reference to a reversible ratchet wrench handle having a novel construction.

Ratchet wrenches having means for changing the direction of operation have been well known in the art for many years. Generally, the actuator for the direction reversing mechanism is some type of knob located on the head portion of the wrench handle. This location for the actuator has two disadvantages. One of these is that turning the actuator is a two handed operation as one hand is needed to hold the wrench handle. The other disadvantage is that the actuator increases the thickness and bulk of the head portion making it more difficult to use the wrench in restricted areas.

Several ratchet wrenches have been developed through the years wherein the actuator for the direction reversing mechanism is located near the hand grip portion of the wrench handle and can be operated by the hand that is holding the wrench handle. Such a construction is disclosed in U.S. Pat. Nos. 228,827; 460,474 and 1,355,239, and these represent the closest prior art known to the applicant. In each of these patents, the direction reversing actuator operates with a pivotal movement and this can result in inadvertent and unwanted actuation during use of the wrench which is also operated by means of a pivotal movement.

Other pertinent prior art known to the applicant are U.S. Pat. Nos. 489,032; 969,379; Re. 13,205; 2,725,772; 3,265,171; 3,967,514 and 4,128,025.

SUMMARY OF THE INVENTION

In the ratchet wrench handle of the present invention the actuator for the direction reversing mechanism is a slidable switch button that is located close enough to the hand grip portion of the handle so that it can be conveniently operated by the thumb of the hand that is holding the handle. This means that the change in the direction of operation is a one handed rather than a two handed operation as is the case with most wrench handles in use at the present time. This location of the actuator also removes it from the head portion of the wrench handle thereby permitting the head portion to be constructed with a thinner, more streamlined profile.

The ratchet wrench handle includes the usual ratchet member in its head portion, and the ratchet is engageable by one tooth or the other of a double toothed pawl. The pawl is connected by an axially movable rod to the switch button, the rod being positioned in a bore in the shank of the wrench handle. With this arrangement the switch button can be moved back or forward, axially of the wrench handle, to engage one or the other of the pawl teeth with the ratchet. The back and forth axial movement of the switch button is advantageous because the button is less likely to be accidentally moved during operation of the wrench than a pivotally or rockably movable lever type actuator.

DESCRIPTION OF THE PREFERRED EMBODIMENT

Figures 1, 2, 3, 4, 5:
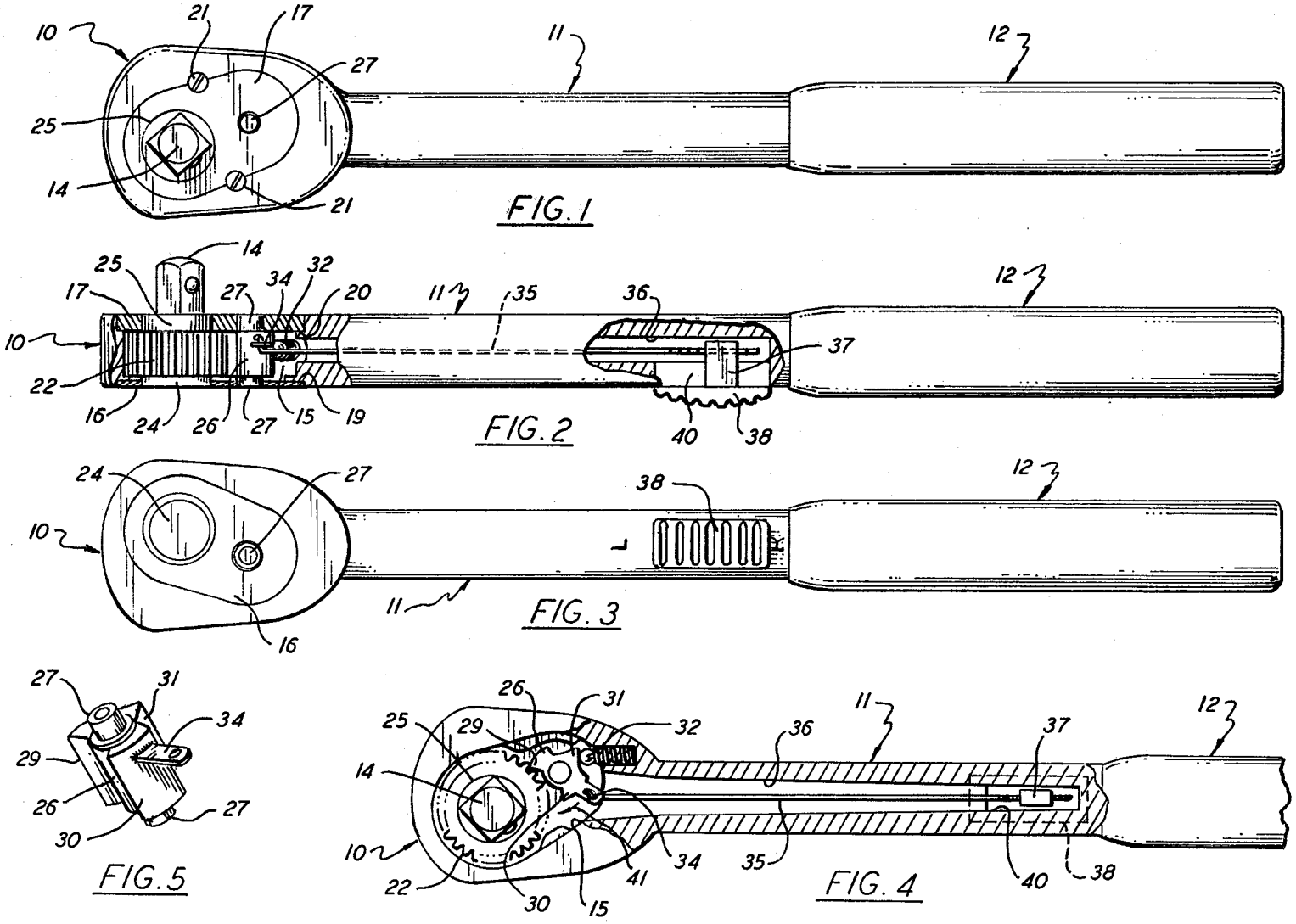
FIG. 1 is a bottom plan view of a reversible ratchet wrench handle embodying the present invention.
FIG. 2 is a side elevation of the handle with portions being shown in section.
FIG. 3 is a top plan view of the handle.
FIG. 4 is a bottom plan view corresponding to FIG. 1 but having portions shown in section.
FIG. 5 is an enlarged perspective view of the double toothed pawl.

Having reference now to the drawings, the wrench handle of the invention is essentially comprised of a head portion 10, a shank portion 11 and a hand grip portion 12 which is grasped by the user. These portions are integral with one another whereby the handle as a whole has a unitary construction. Projecting from the head portion 10, on the under side thereof, is a rotatable drive stud 14 that is adapted to be releasably connected in the usual manner to conventional socket tools (not shown).

The head 10 is formed with a generally eliptical opening 15, FIGS. 2 and 4, the long axis of which is angularly offset from the axis of the handle. The opening 15 is normally closed by upper and lower similarly shaped plates 16 and 17, the edges of which respectively engage recessed shoulders 19 and 20 at the top and bottom of the opening so that the outer surfaces of the plates are flush with the flat surfaces of the head.

The closure plates 16 and 17 are held in position by elongated screws 21, FIG. 1. The heads of these screws engage the lower plate 17 and they pass through the opening 15 and are threaded into upper plate 16. A circular ratchet member or wheel 22 is rotatably mounted in the cavity formed by the opening 15 and closure plates, and this member is formed with integral, circular reduced diameter portions 24 and 25 which are respectively journalled in conforming openings in the plates 16 and 17 as best shown in FIG. 2. The drive stud 14 is integral with the portion 25 and coaxial with the ratchet member.

A double toothed pawl 26 is also positioned in the cavity formed by the opening 15 and closure plates 16, 17, the pawl being mounted for pivotal movement adjacent the ratchet member 22, FIG. 4. To this end, the pawl is formed with upper and lower cylindrical trunnions 27 which are journalled in conforming openings in plates 16 and 17. Pawl 26 is formed on one side with teeth 29 and 30 adapted to engage the circumferential teeth on the ratchet member. On its other side, the pawl is formed with a generally triangular projection 31, FIGS. 4 and 5, one side or the other of which is adapted to be engaged by a spring biased ball detent 32 to releasably hold tooth 29 or 30 in engagement with the ratchet member.

The pawl 26 has an outwardly projecting lug 34 that is connected to one end of a rod 35. The rod extends along an axial bore 36 in the shank portion 11 of the handle and at its other end is threadedly connected to a lug 37 forming a part of an external switch button 38. The lug, FIG. 4, is narrower than the switch button and extends into the bore 36 through a slot 40 in the shank, the slot also serving as a guideway for back and forth movement of the switch button.

With the switch button in its rearward position as shown in FIGS. 2, 3 and 4, the pawl tooth 29 is in engagement with the ratchet member 22 and is releasably held in this position by engagement of ball detent 32 with one side of the pawl projection 31 as shown. When the switch button is moved to its forward position, or to the left in FIG. 4, it acts through rod 35 and the pawl lug 34 to pivot the pawl in the clockwise direction as indicated by arrow 41. This causes the ball detent to be depressed, moves pawl tooth 29 out of engagement with the ratchet member and moves tooth 30 into engagement therewith whereby the direction of operation of the ratchet handle has been reversed. When tooth 30 moves into engagement with the ratchet member, the ball detent moves into engagement with the other side of the pawl projection 31.

As noted hereinabove and as will be apparent from the drawings, locating the switch button 38 close to the hand grip portion 12 enables it to be conveniently operated by the thumb of the hand that is holding the handle. This means that changing the direction of operation is a one handed rather than a two handed operation as is the case with most wrench handles presently available. Locating the switch close to the handle also removes it from the conventional location on the head of the wrench handle thereby permitting the head to be constructed with a thinner, more streamlined profile.

From the foregoing description it will be apparent that the invention provides a novel and advantageous construction for a ratchet wrench handle. As will be apparent to those familiar with the art, the invention may be embodied in other specific forms without departing from the spirit or essential characteristics thereof.

I claim:

1. A reversible ratchet wrench handle comprising a head portion, a hand grip portion spaced from the head portion, a shank portion rigidly connecting the head and hand grip portions together, a ratchet member in the head portion, a double toothed pawl pivotally mounted in the head portion adjacent the ratchet member, a longitudinally movable switch button on the handle adjacent the hand grip portion, and a longitudinally movable rod element positioned in the shank portion and connecting the switch button to the pawl whereby longitudinal movement of the switch button in one direction operates to move one of the pawl teeth into engagement with the ratchet member and longitudinal movement of the switch button in the opposite direction operates to move the other pawl tooth into engagement with the ratchet member.

2. A wrench handle as defined in claim 1 wherein the switch button is located on the handle so that it is easily accessible to the thumb or a finger of the user's hand that is gripping the hand grip portion.

3. A wrench handle as defined in claim 1 wherein the ratchet member is a wheel and the line joining the center said wheel with the pivot point of the pawl is angularly offset from the longitudinal axis of the wrench handle.

4. A reversible ratchet wrench handle comprising a head portion, a hand grip portion spaced from the head portion and a shank portion rigidly connecting the head and hand grip portions, the longitudinal axes of the head, hand grip and shank portions being colinear; the head portion including a rotatable ratchet wheel and a double toothed, pivotally mounted pawl located adjacent the ratchet wheel; the shank portion including a slidable switch member movable back and forth axially of the shank portion, the shank portion being formed with an interior, longitudinally extending passageway having an elongated rod element therein, the rod element being connected at one end to the switch member and at its other end to the pawl whereby movement of the switch member in one direction operates to move one of the pawl teeth into engagement with the ratchet wheel and movement of the switch member in the opposite direction operates to move the other pawl tooth into engagement with the ratchet wheel.

5. A wrench handle as defined in claim 4 wherein the head portion includes a spring biased detent engageable with the pawl to releasably hold its said one or other tooth in engagement with the ratchet wheel.

6. A wrench handle as defined in claim 4 wherein the switch member is located on the shank portion closely adjacent the hand grip portion so that it is easily accessible to the thumb or a finger of the user's hand that is gripping the hand grip portion.

7. A wrench handle as defined in claim 4 wherein the line joining the center of the ratchet wheel with the pivot point of the pawl is angularly offset from the longitudinal axis of the wrench handle.

* * * * *